US006070348A

United States Patent [19]

Bianchetti

[11] Patent Number: 6,070,348

[45] Date of Patent: Jun. 6, 2000

[54] BUBBLE DISPLAY DEVICE

[76] Inventor: Paul E. Bianchetti, Box 1462, McCall, Id. 83638

[21] Appl. No.: 09/186,871

[22] Filed: Nov. 4, 1998

[51] Int. Cl.[7] ..... G09F 19/00

[52] U.S. Cl. ..... 40/406; 40/439

[58] Field of Search ..... 40/406, 407, 408, 40/439, 440, 441, 477, 479, 480

[56] References Cited

U.S. PATENT DOCUMENTS

| | | | |
|---|---|---|---|
| 3,101,564 | 8/1963 | Stoessel . | |
| 3,200,525 | 8/1965 | Francis . | |
| 3,531,635 | 9/1970 | Hancock . | |
| 3,638,342 | 2/1972 | Winslow et al. . | |
| 3,973,340 | 8/1976 | Khawand . | |
| 4,070,777 | 1/1978 | Lo Giudice . | |
| 5,340,024 | 8/1994 | Fuller et al. | 40/406 X |
| 5,349,771 | 9/1994 | Burnett | 40/439 X |
| 5,416,994 | 5/1995 | McLaughlin | 40/406 |
| 5,737,860 | 4/1998 | Whigham et al. | 40/406 |

*Primary Examiner*—Lynne H. Browne
*Assistant Examiner*—William L. Miller
*Attorney, Agent, or Firm*—Robert L. Shaver

[57] ABSTRACT

A visual display device which produces a display utilizing bubbles emitted in liquid filled tubes. A computer controls the timing and size of bubbles emitted into the liquid so as to form designs, which can be symbols, letters, words, or sentences, or pictures. As the bubbles rise through the liquid in a tube, the designs appear to scroll upward, and are replaced from below with a new design.

12 Claims, 7 Drawing Sheets

BUBBLE DISPLAY DEVICE

BACKGROUND OF THE INVENTION

1. Field of the Invention

The present invention generally relates to bubble display devices which may be used for advertising devices, ornaments, or novelties, and more particularly to display devices which form a design using bubbles, such as letters which form words and sentences, or other designs such as symbols of people, arrows, happy face, or other designs.

2. Background Information

There are a number of devices which cause a bubble to be created in liquid to serve as an attention-getting device, or as a novelty. Some of these devices create a stream of bubbles which rise through a liquid in a tube in a continuous fashion. Others create bubbles in a tube which are carried by a liquid throughout the tube to highlight, surround, or add color to display signs. What is lacking in the prior art is a bubble making device which forms designs or letters of the alphabet by bubbles in adjacent columns.

Accordingly, it is an object of the invention to provide a device which forms a display of bubbles in adjacent columns in which the bubbles in adjacent columns form a design or letters of the alphabet. The letters of the alphabet can in turn form words and sentences.

It is a further object that this display of bubbles in a liquid have a scrolling effect as the bubbles rise up through the liquid powered by gravity.

It is a further object of the invention that the device be programmable so that the words and letters of the display can be modified, or so that the designs produced by the display can also be modified.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The foregoing and other objects and advantages are attained by a visual display device which displays a design formed from bubbles which are injected into a number of liquid filled channels. These channels can be cylindrical tubes or could be grooves formed between two plates, or only configuration which would cause bubbles released in columns to remain in discreet columns and not merge together. The visual display device could be used to display patterns and messages to the public in any environment, such as shopping malls, airports, restaurants, amusement parks, businesses and homes. The design formed by the bubbles has a scrolling action, caused by the bubbles rising through the liquid, and induced by gravity. The visual display device of the invention includes a number of generally vertical bubble channels tubes which contain a fluid in which the air bubbles are released, and in which the display is formed. The device includes a fluid which is used to fill the channels or tubes and into which the bubbles are released. It also includes a bubble emitter for each bubble channel or tube, which emits a bubble of air at selected times into the fluid contained in the tube. The bubble emitters are controlled by a control means, which coordinates the timing and the size of the bubbles emitted into the tubes. Coordination of the timing and size of the bubbles allows the emitted bubbles to form a design.

The device also includes an air source for supplying air to the bubble emitters which emit bubbles into the tubes. The bubbles of the device rise by gravity through the liquid in the tubes and their rising forms a scrolling display of designs, the designs formed by bubbles in the adjacent bubble tubes.

The device can include a chamber which is filled with the fluid and in which are mounted the bubble tubes. In this configuration the fluid would fill the chamber and the tubes, so that as a bubble pushed fluid out the top of a tube, other fluid could enter at the bottom of a tube. The design formed by the bubbles can make up a letter, which in turn can make up a word and a sentence. A light source can also be included for illuminating the bubbles and fluid. Also included is a computer which can serve as the control means, and which has an input means and a signal output means. The computer sends out signals to an air control means for timing the emission of bubbles into the fluid and tubes. The input means can be the keyboard, such as a computer keyboard, or it can also be through a signal sent through a serial port from another computer, or it can also be through the installation into the computer of a programmed Electrically Programmable Read Only Memory (EPROM) chip. Another input means can be by the use of a phone connection, over which signals are sent to change the timing and size of bubbles to form a new design. The device can also include an air manifold for distribution of air to the bubble emitters and a solenoid for controlling the flow of air to the bubble emitters.

Another feature of the device is a bubble emitter which includes an emitter tube which is oriented generally vertical and has tube walls and an uppermost and a lowermost end, and is in the shape of an inverted test tube, in which its uppermost end is closed and the lowermost end is equivalent to the open end of a test tube, and is oriented downward in the bubble tube. The tube walls of the emitter tube contain an orifice which is generally circular and through which a bubble is released. An air line is routed into the emitter tube and provides for the controlled delivery of air to the upper part of the emitter tube. As the upper part of the emitter tube is filled with air, surface tension tends to keep the air bubble from exiting the emitter tube out the orifice. However, at some point the size of the bubble overcomes the surface tension of the liquid, and a bubble escapes through the orifice of the emitter tube and begins to travel up the bubble tube.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
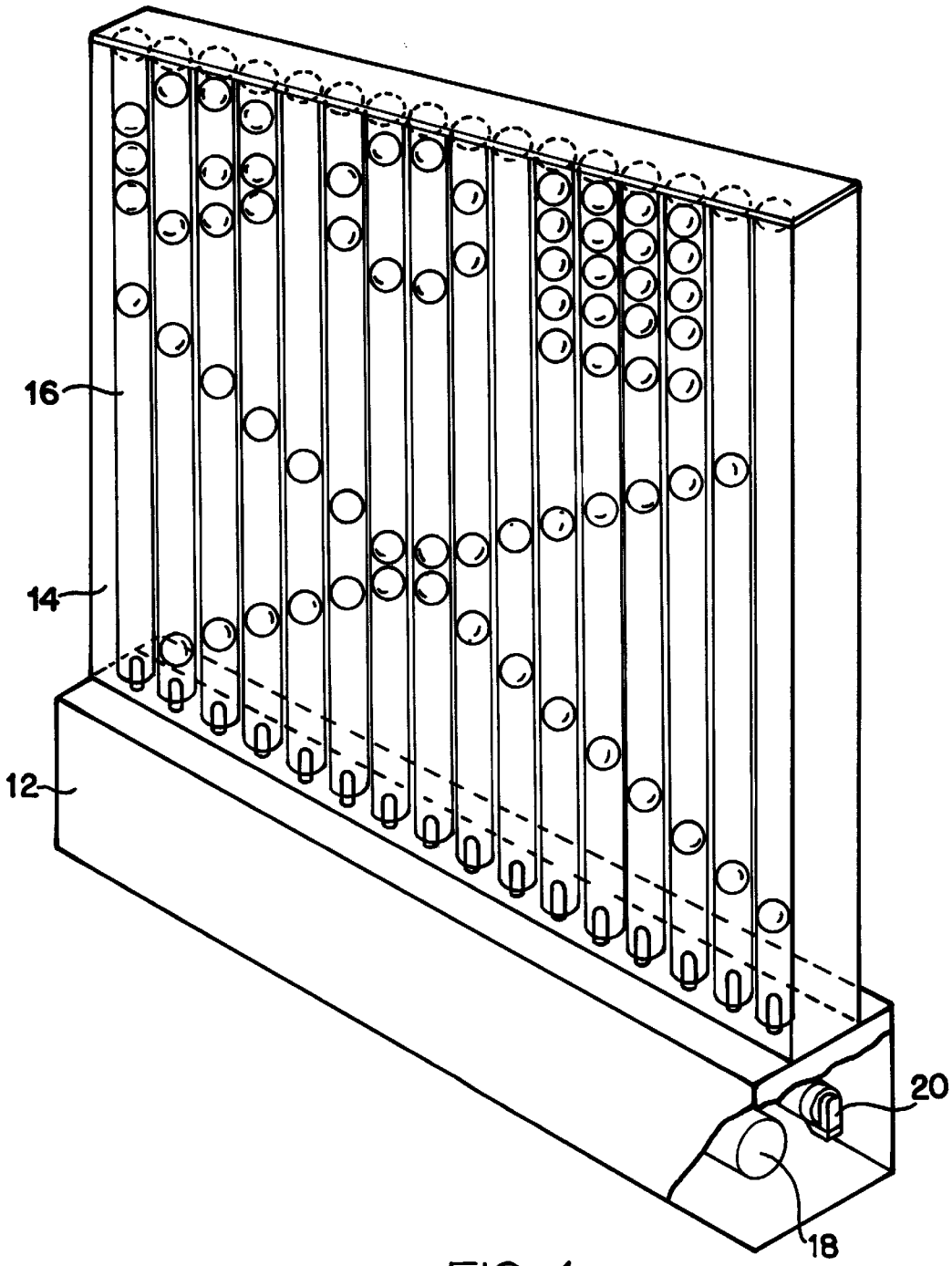
FIG. 1 is a perspective view of the bubble display device showing a pattern of bubbles which form the word GO with exclamation points and an "X" design.

The preferred embodiment of the invention 10 is shown in FIGS. 1 through 7. The device is shown to advantage in FIG. 1 and includes a base 12, a fluid chamber 14, bubble tubes 16, an air manifold 18, a light 20, and a top 70.

Figure 2:
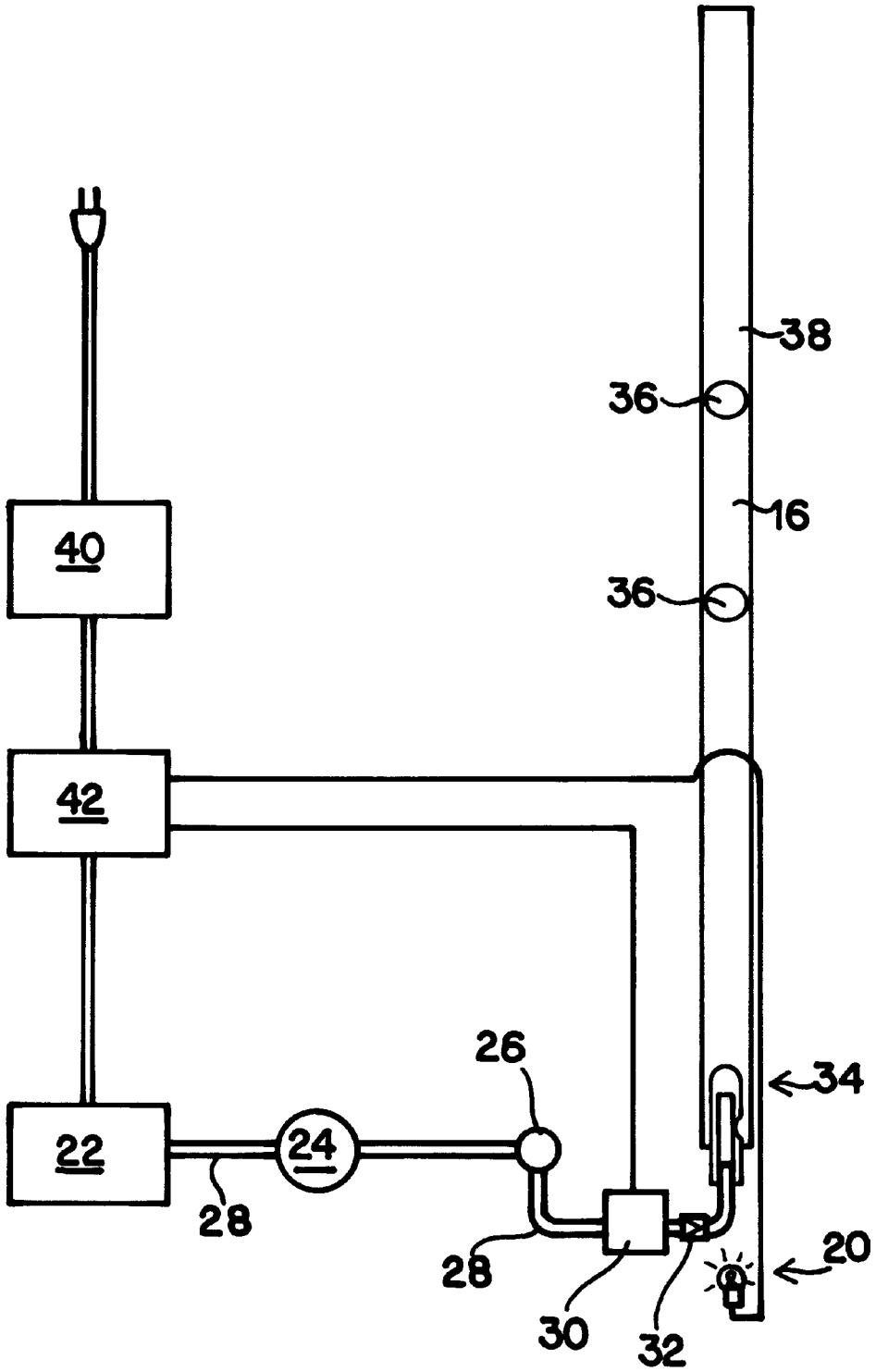
FIG. 2 is a diagrammatic representation of the components of the bubble display device.
Figure 3:
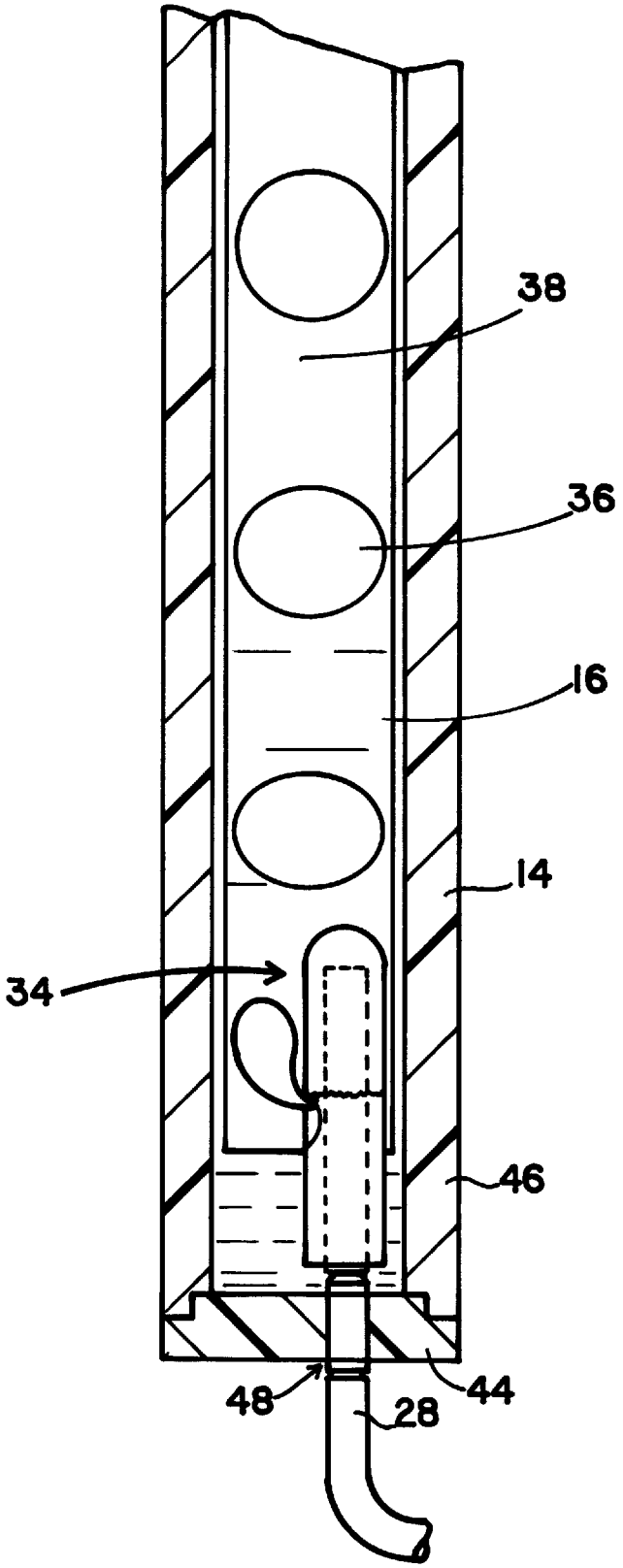
FIG. 3 is a cut-away side view of a bubble tube and a bubble emitter in a chamber.
Figure 4B:
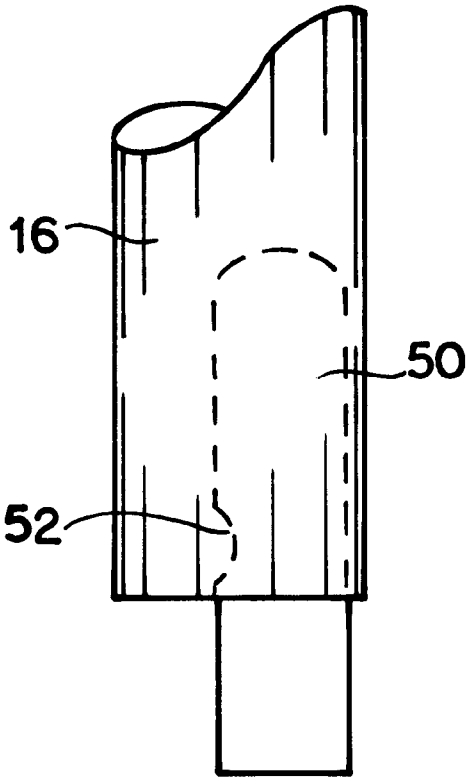
FIG. 4B is a side view of a bubble emitter inside of a bubble tube.
Figure 4A:
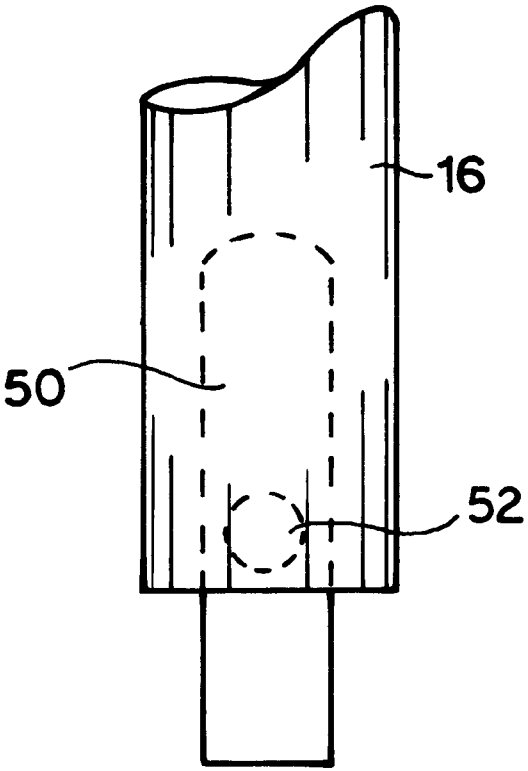
FIG. 4A is a front view of a bubble emitter inside of a bubble tube.

The interactions of the mechanical parts of the device are shown in the block diagram of FIG. 2. As shown in FIG. 2, 22 is an air pump which supplies air to air tank 24 and air manifold 26. From the air manifold 26, an air line 28 goes to a two-way solenoid valve 30. From the two-way solenoid valve 30 an airline 28 goes to a one-way check valve 32. Past the check valve 32, air line 28 goes to a bubble emitter 34, which is mounted inside a bubble tube 16. The device can optionally include a light 20, which is mounted preferably below the bubble tube 16 and illuminates the bubbles 36 and the fluid 38. A power source 40 is included which supplies power to the air pump 22, the control means 42 and the light 20.

In the preferred embodiment, the fluid chamber 14 is made of clear acrylic plastic ranging in thickness from ¼" to ½". The fluid chamber 14 of the preferred embodiment is approximately 36 inches high, 10 inches long, and 3 inches deep. The fluid chamber 14 has a bottom 44 in which is drilled a hole 48 for the passage of an air line 28 for each bubble tube 16, each of which are contained within the fluid chamber 14. Preferably, the sides 46 and bottom 44 of the fluid chamber 14 are solvent glued together, although the fluid chamber 14 could also be molded to the shape of the preferred embodiment or to any other shape which would contain or form channels for the passage of bubbles through fluid. In the preferred embodiment, the bubble tubes 16 are plastic tube 1 inch in diameter, and 36 inches in length, and have a 1/32" wall thickness. Although in the preferred embodiment they are made of polybutyrate clear plastic, glass or any other transparent or translucent material would be equally suitable, the equivalent of bubble tubes could be formed by any configuration which causes adjacent columns of bubbles to remain discreet and not merge together. A variety of diameters and lengths would also be appropriate variations and would be varied according to the desired display created with the technology of the invention.

The air pump 22 is a diaphragm or piston-type air pump capable of the minimum pressure of 10 PSI. the preferred embodiment utilizes an aquarium air pump. The air storage tank 24 holds air pressure up to 100 PSI. The volume of the air tank 24 depends upon the number of bubble emitters used, with a minimum of about one cubic foot. The air hose 28 is one-quarter inch inside diameter, and can be made from a variety of material, such as plastic, rubber, aluminum, steel, copper, or any type of metal or plastic which is suitable for holding a fairly low pressure. The preferred embodiment of the invention is a module which contains eight or sixteen bubble tubes, but it is obvious that the invention can be practiced independent of the number of tubes or modules. For instance, a display using four bubble tubes may be sufficient to display a pattern of zigzagging air bubbles or a happy face, and an entire wall of a room could be devoted to bubble tubes and the apparatus of the invention, so that letters, words and sentences could be formed on the wall, along with detailed images or symbols. This type of application might involve the use of scores of bubble tubes, or an indefinite number, depending upon the size and nature of the display desired.

The preferred embodiment utilizes a manifold into which air is delivered by air line 28. From the manifold 18, air lines 28 deliver air to individual bubble emitters 34 of the display 10. In the case of a display device 10 shown in FIG. 1, sixteen air lines 28 deliver air to the 16 bubble emitters 34 of the display. The two-way solenoid air valves 30 are common type 12 or 24-volt DC. These are generally miniature solenoid valves of a low pressure type, with a good frequency response. Included in the air line 28 between the air manifold 26 and the bubble emitters 34 is a one-way check valve 32. The check valve 32 is a small, common ball-type valve. A ball type is used because of its low pressure operation with high reverse pressure. The blocking side of the check valve 32 is connected via an air line 28 to the bubble emitter 34.

Figure 5A:
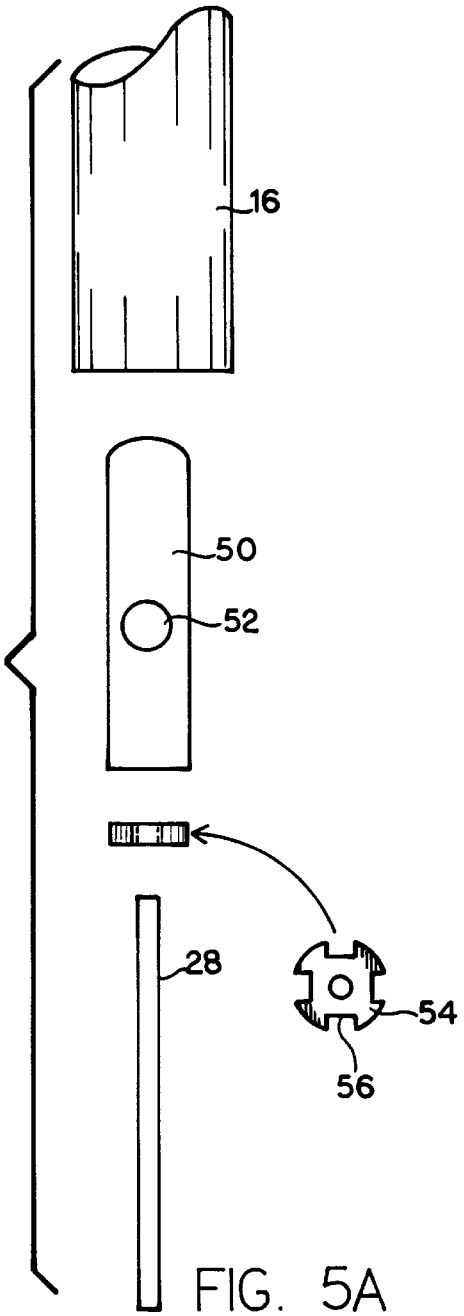
FIG. 5A is an exploded view of a bubble emitter in a bubble tube.
Figure 5B:
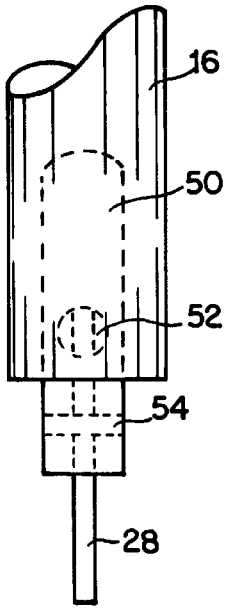
FIG. 5B is a view of a bubble emitter inside a bubble tube with an centering washer and air line attached.

The bubble emitter 34 is composed of three parts, as shown in FIG. 5A. A first part is an emitter tube 50, which is configured like an upside down test tube with a hole drilled in its side. In the preferred embodiment, it is a 12 mm ×75 mm clear plastic test tube with a ⅜" hole drilled in its side. The hole forms an orifice 52, as shown in the figures. Also included in the bubble emitter 34 is a centering washer 54. Centering washer 54 has a hole in its center, and grooves 56 cut into its sides. The ungrooved portions of the sides of centering washer 54 fit snugly against the inner walls of the emitter tube 50. An air line 28 passes through the hole in the center of the centering washer 54 and fits and serves to center the air line 28 within the emitter tube 50, as shown in FIG. 5B. The grooves 56 are for the purpose of allowing fluid 38 to freely communicate from the fluid chamber 14 to the interior of the bubble tube. The emitter tube 50 is glued to the inside wall of a bubble tube 16. When in operation, the bubble emitter 34 and the air line 28 are immersed in fluid 38 inside the fluid chamber 14. A small pocket of air is trapped inside the top portion of the emitter tube 50. When a short burst of air is admitted by the 2-way solenoid valve 30 and arrives at the end of the air line 28, it displaces a small amount of air already trapped in the emitter tube 50, and forces a bubble out the orifice 52 into the fluid 38. The bubble floats upward through the solution inside the bubble tube 16. Bubbles can be spaced one inch apart without merging. The air pulse from 10 to 100 milliseconds to form small to large bubbles.

The fluid is a thick solution which slows the ascent of a bubble depending on the viscosity of the fluid. A suitable fluid is a mixture of light corn syrup thinned with water. Bleach is added to prevent microbial growth. The three components are blended in a ratio of 8:1 1/2:1/2 of corn syrup, water and bleach.

Figure 6:
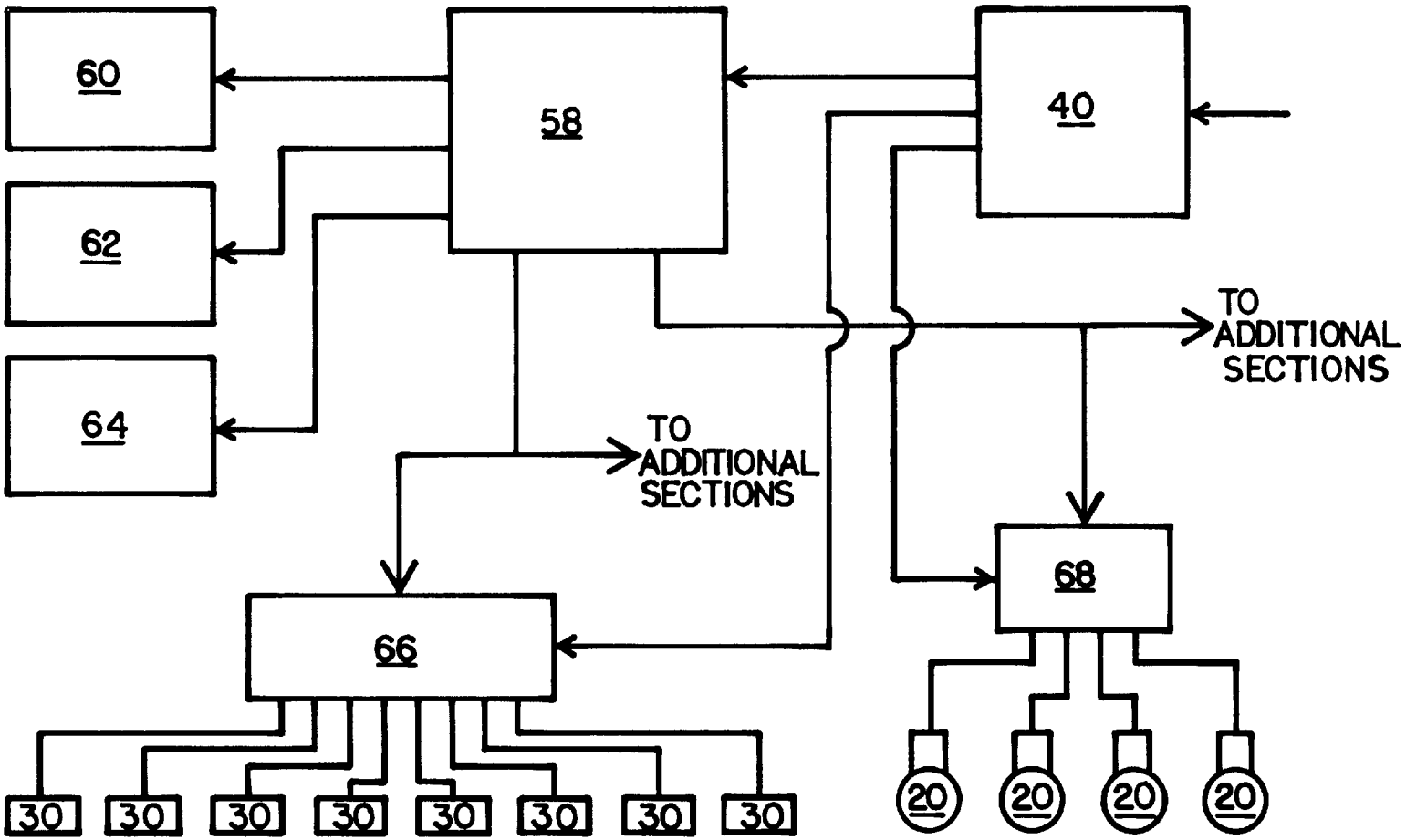
FIG. 6 is a block diagram of the electronic section of the bubble display device.
Figure 7:
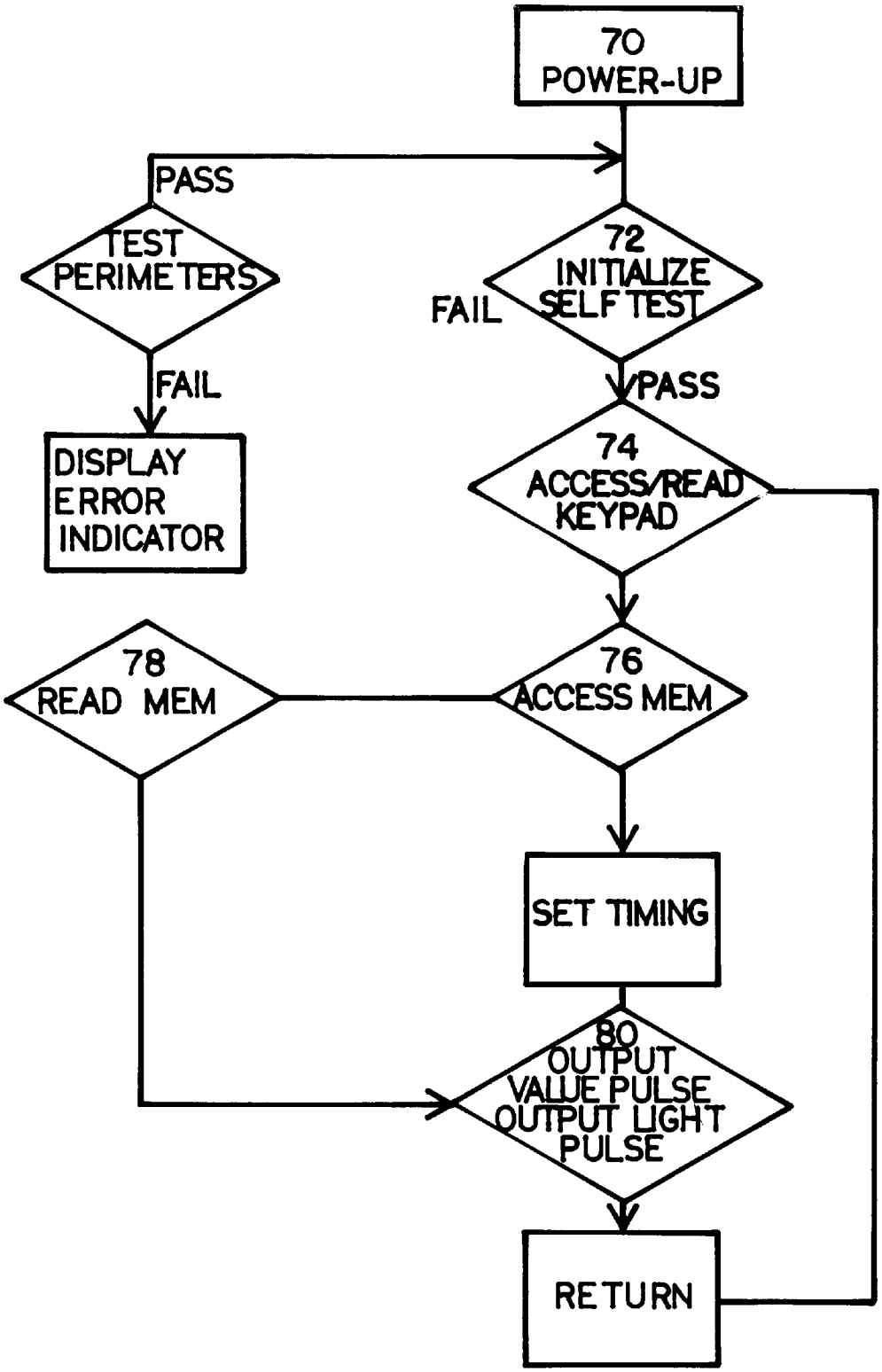
FIG. 7 is a flow chart diagram showing the software operation.

FIG. 6 illustrates a block diagram of the electronic components for the display. The electronics are capable of operating several display sections, which are typically eight bubble tubes per section. The same system could function for one section with eight tubes, or many sections or an unlimited number of tubes. The preferred embodiment uses one section with eight or sixteen tubes, so that multiple sections can be assembled side-by-side as components of an expandable system. However, other installations could be built with one section with any number of tubes within that section. The electrical system operates the air valves and lighting, coordinating their operation to form a desired display in words, sentences, designs and patterns. The circuit operates from a program stored in memory. A switching DC power supply 40 is used to supply power to the electronics and to 2-way solenoid valves 30 and lights 20. The output of power supply 40 is 5, 12 or 24 volts, depending upon the type of valve 30 which is utilized in that particular installation.

The central processing unit (CPU) is shown at 58 and in the preferred embodiment is an Intel 80 C-52 BASIC Microprocessor. The processor can be programmed in BASIC or machine code. This processor controls the circuit functions that accesses the program memory. The program memory is stored in an Electrically Programmable Read Only Memory (EPROM) 60, which is 8K to 64K in size. A number of non-volatile memory devices will work for this function, such as an electrically erasable programmable read only memory (EEPROM) chip or a non-volatile ram (NVRAM), which has a built-in lithium battery, or something similar. In the preferred embodiment RS-232 serial port 62 is used to program the circuit and to communicate with the display device 10 via a telephone line. The RS-232 port 62 can also be used for diagnostic functions. A keypad/console 64 is included an optional method to input into and interact with the display. Such a keypad data input option would be a feature where ease of changing the message is desirable by the device operator or for use in a public area, such as a mall or an airport. In such a public situation, a person viewing the display could select the patterns, lighting and message of the display for his entertainment.

The 8 bit lines of the CPU 58 are connected to a Field-Effect Transistor (FET) transistor array drive circuit 66 to control the 2-way solenoid air valves 30 of the display device 10. The light control circuit 68 is a similar circuit, except that it also has added to it a digital to analog converter (not shown). The light control circuit 68 can turn on, off, dim or brighten the lights 20. In the preferred embodiment, these lights 20 are 4-color lamps. Each color may be operated independently or simultaneously. The lamps 20 are 12 to 20 volts DC and the colors red, blue, green and yellow are utilized. In the preferred embodiment, each bubbler section may consist of 8 bubble tubes, as shown in FIG. 6, or 16 bubble tubes, as shown in FIG. 1. Additional sections can be added with 64 bubble tubes being a desirable configuration. However, the concept of the invention can be utilized with any number of bubble tubes, simply by taking the principles described herein and scaling them up as required for more bubble tubes. In this way, a display utilizing hundreds or thousands of bubble tubes is within the scope of the invention. A real time clock circuit is part of the processor support circuit to communicate with the processor for operation of a sleep mode for non-business hours and holiday patterns or messages.

FIG. 8 is a flow chart diagram showing the software operation of the bubble display device 10. When power is first applied at 70, the processor reads the program at the first instruction from the memory. The first routine is a self-test program 72 to test and verify that the system is working. If the system fails, the tests are performed again and some type of indicator would instruct the customer to act if the system fails again. If the system passes the self test 72, the software will instruct the processor to look for a keypad/console at 74. If the keypad/console is detected, the buttons of the keyboard are scanned for input during normal program operation. The next block of code accesses the memory at 76 and reads the data at 78 for valve operation, timing and light control. The data is converted to a high and low pulse, and the processor is instructed to output the pulse data at 80 to the data bus connected to the light and valve drive circuits. This process will produce a single row of bubbles and set a light pattern. The software returns to scan the keypad (if present), and reads the next set of data in memory to form the pattern desired. The light driver circuit responds to the next instruction to change a light pattern. The software runs continually until all patterns and words are formed, then repeats endlessly until interrupted by the console or master reset.

While there is shown and described the present preferred embodiment of the invention, it is to be distinctly understood that this invention is not limited thereto but may be variously embodied to practice within the scope described above and in the following claims.

I claim:

1. A visual display device for displaying one or more designs which comprises:

a plurality of generally vertical bubble tubes which contain a fluid, for displaying and conducting air bubbles emitted into said tubes, a bubble emitter for each tube, for emitting a bubble of air at selected times into said fluid contained in said tube;

a bubble emitter control means for coordinating timing and size of bubbles emitted into said tubes, so that said bubbles in said tubes form said design;

an air source, for supplying air to said bubble emitters, for emitting into said tubes;

said tubes are contained in a chamber filled with said fluid; wherein said bubbles rise by gravity through said fluid in said tubes and form a gravity induced scrolling display of said designs formed by said bubbles in said tubes.

2. The visual display device of claim 1 in which said scrolling display comprises one or more letters.

3. The visual display device of claim 1 which further comprises a light source for illuminating said bubbles.

4. The visual display device of claim 1 in which said bubble emitter further comprises an emitter tube oriented generally vertically, with tube walls and an uppermost end and a lowermost end, in which at least said uppermost end is closed, and with said tube walls defining an orifice for the release of a bubble or air, and said tube enclosing an air line, which is for the controlled delivery of air to said emitter tube.

5. The visual display device of claim 1 in which said control means is a computer with an input means and a signal output means, which sends out signals to an air control means for timing an emission of bubbles.

6. The visual display device of claim 5 in which said input means is a keyboard.

7. The visual display device of claim 5 in which said input means is through a serial port from another computer.

8. The visual display device of claim 5 in which said input means is through a programmed electrically erasable programmable read only memory (EEPROM) chip, which can be installed into said computer.

9. The visual display device of claim 5 in which said input means includes a phone connection.

10. The visual display device of claim 1 which further comprises an air manifold for distribution of air to said bubble emitters.

11. The visual display device of claim 1 which further comprises a solenoid for controlling flow of air to said bubble emitters.

12. A visual display device for displaying one or more designs which comprises:

a chamber in which are mounted a plurality of generally vertical bubble tubes;

said plurality of generally vertical bubble tubes in open communication with a fluid in said chamber, for displaying and conducting air bubbles emitted into said tubes;

said fluid for filling said chamber and said tubes;

a bubble emitter for each tube, for emitting a bubble of air at selected times into said fluid contained in said tube;

a bubble emitter control means comprising a computer with an input means and an output signal, for coordinating timing and size of bubbles emitted into said tubes, so that said bubbles in said tubes form said design;

an air source, for supplying air to said bubble emitters, for emitting into said tubes; wherein said bubbles rise by gravity through said fluid in said tubes and form a gravity induced scrolling display of said designs formed by said bubbles in said bubble tubes.

* * * * *